United States Patent [19]

Hunt, IV et al.

[11] 4,254,589

[45] Mar. 10, 1981

[54] BELT REFURBISHING

[75] Inventors: Walter H. Hunt, IV; Lynn W. Craig, both of Louisville, Ky.

[73] Assignee: Rohm and Haas Company, Philadelphia, Pa.

[21] Appl. No.: 962,826

[22] Filed: Nov. 22, 1978

[51] Int. Cl.[3] ..... B24B 1/00

[52] U.S. Cl. ..... 51/318; 51/322; 51/326; 425/471

[58] Field of Search ..... 51/281 R, 317, 318, 51/322, 326; 29/400 RL, 33 S; 425/471

[56] References Cited

U.S. PATENT DOCUMENTS

| | | | |
|---|---|---|---|
| 2,058,670 | 10/1936 | Doorbar | 425/471 |
| 2,070,944 | 2/1937 | Hillix | 51/317 X |
| 2,177,316 | 10/1939 | Giles | 51/322 X |
| 2,710,502 | 6/1955 | Lyon | 51/322 |
| 2,818,696 | 1/1958 | Pigott | 51/322 X |
| 3,277,609 | 10/1966 | Horie | 51/281 R |
| 3,728,066 | 4/1973 | Stadler | 425/471 |
| 3,763,602 | 10/1973 | Boettcher | 51/318 X |

*Primary Examiner*—Gary L. Smith
*Attorney, Agent, or Firm*—Jordan J. Driks

[57] ABSTRACT

Stainless steel belts having a thickness of about 0.060 inch used for casting sheet materials such as acrylic plastic sheet are refurbished by first grinding the back surface of the belt until no further distortions can be removed and then grinding the mirrored surface of the belt until said mirrored surface is uniformly dull and thereafter polishing the dulled surface to a mirrored finish. During the grinding and polishing, the belt is cooled to avoid local overheating.

14 Claims, 2 Drawing Figures

DISTORTED AREA BEFORE REFURBISHING

DISTORTED AREA AFTER REFURBISHING

BELT REFURBISHING

BACKGROUND OF THE INVENTION

Stainless steel belts which are used in the manufacture of optically clear polymeric sheet, such as acrylic sheet, must be flat and must have an optically polished finish on the casting side of the belt. When the steel, from which the belt is made, is manufactured at a steel mill, it is generally softer and thicker than is desired. In order to obtain the desired thickness and to increase the hardness of the steel to give it sufficient strength so that it will not stretch when used with a tensioning system, such as cylinders or other tensioning devices, over which the belt revolves and is kept substantially flat, the steel is cold rolled. The cold rolling operation results in the introduction of surface stresses on both surfaces. When additional stresses are introduced onto one surface of the belt, for example the top, the belt moves to restore the equilibrium. Thus, deformations in the surface of the belt are compensated for, to reestablish the stress equilibrium, by deformations on the back of the belt. Additionally, deformations on the back of the belt will result in deformations on the mirrored surface of the belt. These deformations will appear in the material being cast on the mirrored surface of the belt.

When the belt is in use, the cylinders over which the belt rotates may be 100 feet or more apart and will be suitably tensed so that the mirrored surface of the belt will be substantially flat. Because the distance between the cylinders may be 100 feet or more, it is necessary that supporting means, such as steel idler rolls, extend at spaced intervals across the width of the belt. These supporting means, such as steel idler rolls, are generally not driven and serve to support the belt. However, such support actually takes place at points of contact between the supports and the belt. These point contacts, because of friction or compressive effects, eventually scratch, planish, or abrade the underside of the belt at the contact points. This abrading, planishing or scratching disturbs the stress equilibrium in a local area so that the change of stress on a local area on the back of the belt results in a shape change on the corresponding local area on the mirrored surface of the belt in order to restore the stress equilibrium. This results in a deformation of the mirrored surface and is translated onto the surface of the material which is being cast on the mirrored surface.

When the deformation on the mirrored surface becomes substantially severe so that articles cast thereon are not commercially acceptable, the belt is removed and replaced with a new belt and the old belt is generally sold for its scrap value. This results in the loss of production time and the expenditure of considerable sums of money for a new belt.

It is an object of this invention therefore to provide a process for refurbishing a distorted steel belt used for casting polymeric materials such as acrylic sheet.

Another object of this invention is to refurbish a new belt so that the new belt has less distortion than when received from the manufacturer.

Other objects and advantages will become apparent from the following more complete description and claims.

SUMMARY OF THE INVENTION

Broadly, this invention contemplates a process for refurbishing the surface of a steel belt having a mirrored surface which has excessive optical distortion and a distored back surface which comprises grinding the back of the belt across its width with a rotating motion parallel to said back surface until no further distortion can be removed from the back of the belt, grinding the mirrored surface of the belt across its width with a rotating motion parallel to said mirrored surface until such mirrored surface is uniformly dull, polishing the dulled surface to a mirrored finish while supporting the back surface under the area of dulled surface being polished and cooling the belt during said grinding and polishing.

This invention also contempates a refurbished steel belt prepared according to the above process and having the distortion pattern substantially as shown in FIG. 2.

DETAILED DESCRIPTION

Figure 1:
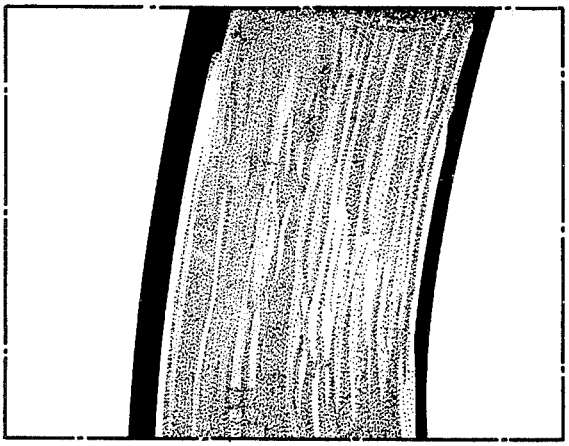
FIG. 1 is a drawing prepared from a photograph of distortion lines projected onto a screen by shining a point light source through an optically clear casting of an acrylic sheet which has been cast from a section of belt having a distorted mirrored surface before refurbishing of the belt.
Figure 2:
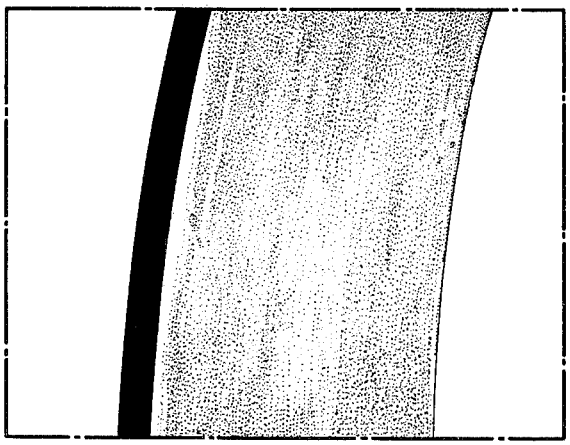
FIG. 2 is a drawing prepared from a photograph of distortion lines projected onto a screen by shining a point light source through an optically clear casting of an acrylic sheet, cast from the same section of belt as the sheet of FIG. 1, after refurbishing of the belt according to the process of this invention.

When it is determined that a steel belt, such as stainless steel, used in the casting of optically clear sheet, has become badly distorted from examination of the sheet cast thereon, the belt may be refurbished in place without removing it from its location.

Any steel belt, such as a stainless steel belt, used in the casting of optically clear sheet may be refurbished according to this invention. The thickness, length and width of the belt may vary widely. In the casting of optically clear sheet, the belt will generally be of a thickness of about 0.060 inch but this thickness may vary widely from about 0.020 inch to about 0.100 inch.

Although this invention is described in terms of its applicability to optically clear polymeric sheet, the process of this invention may also be applied to steel belts used for the casting of other materials.

When refurbishing a distorted belt, the interior side of the belt (the back of the belt) is first ground to remove distortion. Grinding is accomplished using an ordinary sanding machine, such as a floor sander or any other sanding machine which has a rotary motion.

Whatever grinding apparatus is used, it is important that the grinding apparatus have a rotating motion. A grinding apparatus having a motion, other than a rotating motion, is not desirable because objectionable distortion patterns may be introduced onto the surface being ground.

The grinding apparatus itself, should have a disc which has an average diameter of at least about 3 times the distance between one distortion peak in the belt and the next adjacent distortion peak. Thus, the grinding disc will have a sufficiently large average diameter to span the distortion peaks in the belt and will assure a uniform grinding of the surface concerned. The distance between distortion peaks may readily be determined by making a casting on the distorted mirrored surface. The grinding disc may rotate at a rate of from about 10 rpm to about 500 rpm and preferably from about 100 rpm to about 250 rpm.

It is important that the grinding, whether of the mirrored surface or the back surface, be accomplished in a plane parallel to the surface being ground. In this manner, the introduction of additional distortion as a result of the grinding disc or wheel cutting into the surface being ground, is avoided.

When grinding a typical steel belt, such as a stainless steel belt, it has been found that approximately 100 passes with the grinding apparatus may be required to satisfactorily remove all of the distortion possible from the back side of the belt.

Grinding of the back may be accomplished using a silicon carbide closed coat sanding disc having a grit of at least about 200 and preferably a grit of from at least about 20 to about 80. It is most preferred that the sanding disc used to grind the back of the belt have a grit of about 36.

Although a sanding material of less than 20 grit can be used, there is no advantage in using such a more coarse material and although a grinding material in excess of 80 grit may be used, the use of finer materials will normally result in the expenditure of additional time to grind the back of the belt.

It is preferred that the grinding disc which is used be sufficiently rigid so that when a surface of the belt is being ground, the grinding disc will grind across the distortion peaks and will not conform to the distortion peaks and valleys of the distorted belt. Alternatively, if the grinding disc is not sufficiently rigid, then a rigid member which conforms to the disc configuration may be placed or bonded on the surface of the disc remote from and parallel to the surface being ground.

Instead of a grinding disc, a slurry of an abrasive material such as silicon carbide with water may be used.

Other materials such as aluminum oxide, pumice, silica, and any other grinding material whose hardness exceeds the hardness of the steel surface being ground may be used. These materials may also be used in the form of an aqueous slurry or as part of a sanding disc.

Grinding itself is accomplished while depositing water or other coolant on the surface being ground to prevent localized overheating which can cause expansion and thus introduce additional distortions into the surface being ground.

The temperature of the surface being ground, whether the back side or mirrored surface, should be kept, as close as possible to the ambient temperature of the belt and temperatures in excess of about 80° C. should be avoided to prevent local overheating and the disadvantages attended thereto.

The belt itself is ground across its entire width at a rate of up to about 15 feet or greater per minute. A rate of grinding of as low as 0.5 ft. per minute may be used. However, at this slow rate of grinding, care must be taken that sufficient coolant is used to prevent a heat buildup which would result in the introduction of additional distortions into the belt. Although a rate in excess of 15 feet per minute may be used, unless a means is provided to dampen excessive vibration of the belt at rates in excess of 15 feet per minute, the excessive rate in excess of 15 feet may result in a non-uniform grinding and the introduction of additional distortions into the surface being ground.

Grinding may be accomplished using the weight of the grinding apparatus as the sole pressure applied to the surface being ground. Alternatively, pressures of up to 25 psi may be used. Additionally, the grinding apparatus may be counterweighted so that the pressure applied to the surface being ground will be less than the pressure applied by the weight of the grinding apparatus alone.

Grinding of the back of the belt is continued until no further distortions can be removed from the back of the belt. This may be determined by periodically casting a sheet, such as an acrylic sheet, on the mirrored surface of the belt and examining the sheet to determine whether additional distortions have been removed.

The mirrored surface of the belt is ground in the same manner as is the back surface of the belt. However, when grinding the mirrored surface of the belt, a grinding material having a grit of from about 20 to about 100 may be used.

A coolant, such as water, is also injected when grinding the mirrored surface of the belt in order to avoid local overheating.

The mirrored surface of the belt is ground until such surface has become uniformly dull.

The pressures set forth for grinding the back of the belt may also be utilized when grinding the front of the belt.

When grinding the mirrored surface of the belt, it is preferred that a flat rigid support be placed under the mirrored surface and that a resilient material be disposed on top of the support and in contact with the back side of the belt below the mirrored surface being ground. In this way, the mirrored surface of the belt may be prevented from bending under the weight of the grinding apparatus or the pressure applied to the mirrored surface.

The rigid support may be any suitable rigid member and the resilient material may be any suitable substance such as foam rubber, polymeric foam, or other resilient material.

Alternatively, support for the mirrored surface during grinding may be pneumatic, such as by a strong flow of air or such support may be hydraulic.

The pressure which is applied when grinding the mirrored surface and the back of the belt is a downward pressure applied against the surface being ground. Although an upward pressure may also be used, such upward pressure would require the presence of another apparatus to provide such pressure.

After the mirrored surface has been ground so that the surface is now uniformly dulled, the mirrored surface must be polished to again obtain a mirror-like surface suitable for casting materials thereon. The polishing of the dulled surface to a mirrored surface may be accomplished in any manner which is known to the art and is not critical to the practice of this invention. Thus, the same apparatus may be used and the polishing materials may comprise such materials as pumice, aluminum oxide, cerium oxide, and the like either as an integral part of a polishing disc or as an aqueous slurry.

When polishing the dulled surface, supporting means, as aforedescribed in connection with the grinding of the mirrored surface, is always provided to avoid a non-uniform polishing. This supporting means may, if desired, also be utilized when grinding the back surface of the belt.

In order to more fully illustrate the nature of this invention and the manner of practicing the same, the following example is presented.

EXAMPLE

An endless stainless steel belt is tensed between two 5 foot diameter rolls. The belt, 400 ft. long×116 inches wide×0.060 inch thick and having excessive optical distortion, is ground on the backside with five grinding machines, pivotally connected to a rigid bar, to permit free vertical motion, which rigid bar is mounted above the backside surface and extends across the belt's width. Each grinding machine uses a 15 inch outside diameter by 3 inch internal diameter, 36-grit silicon carbide sanding disc backed with a flat wooden backing, rotating at 174 RPM and having a downward pressure of 0.25 psi. The grinding assembly discs move back and forth for about 15 inches, grinding the belt's width at a rate of 8 feet per minute and rotating in a plane parallel to the belt surface being ground. The belt travels forward at a rate of 10 feet per minute and is unsupported on the underside. During the grinding operation, water flowing at a rate of 0.5 gallon per minute per grinding machine is injected onto the belt near the center of each grinding disc. One-hundred passes are made at which time it is determined, by sample castings, that the surface stresses on the backside of the belt are uniform across the belt's width since no additional distortion is removed by continued grinding. At this time, approximately 50% of the distortion existing initially in the belt surface is removed.

The belt is then ground on the mirrored surface with 15 grinding machines, each using 15 inch outside diameter×3 inch internal diameter grinding discs. The grinding machines are mounted above the mirrored surface and in a manner set forth above except that the grinding machines do not pivot vertically. Each disc utilizes a 60-grit silicon carbide sanding disc backed with a machined flat cast iron plate which itself is backed by a 1½ inch, 600 diameter Shore A scale flat rubber disc bonded to the grinding machine and to the iron plate and rotating at 200 RPM and having a downward pressure of 0.3 psi. The grinding disc assembly moves back and forth for about 8 inches, grinding the belt's width at a rate of 3 feet per minute and rotates in a plane parallel to the belt surface being ground. The belt travels forward at a rate of 1 foot per minute and is supported on the backside with a canvas backing covering over a ½ inch thick layer of foam rubber which is mounted onto a rigid machined, flat steel plate.

During the grinding operation, water flowing at a rate of 0.25 gallon per minute per grinding machine is injected onto the belt at the center of the grinding disc.

Seventy passes are made at which time it is determined that the mirrored surface is now uniformly dulled. The belt is then repolished to a mirrored finish, using an aluminum oxide polishing compound and utilizing the same canvas backing and support set forth above. A casting of a polymeric sheet on the refurbished belt shows substantially reduced distortion.

While this invention has been described in terms of certain specific embodiments and illustrated by means of a specific example, the invention is not to be construed as limited except as set forth in the following claims.

I claim:

1. A process for refurbishing the surface of a steel belt having a mirrored surface which has excessive optical distortion and a distorted back surface comprising grinding the back surface of the belt across its width with a rotating motion parallel to said back surface until no further distortion can be removed from the back of the belt, grinding the mirrored surface of the belt across its width with a rotating motion parallel to said mirrored surface until said surface is uniformly dull, polishing the dulled surface to a mirrored finish while supporting the back surface under the area of dulled surface being polished and cooling the belt during said grinding and polishing.

2. A process according to claim 1 wherein said back surface is ground with at least about a 20 grit grinding material.

3. A process according to claim 1 wherein said mirrored surface is ground with at least about a 20 grit grinding material.

4. A process according to claim 1 wherein said back surface is ground with from about a 20 grit to about a 80 grit grinding material.

5. A process according to claim 1 wherein said mirrored surface is ground with from about a 20 grit to about a 100 grit grinding material.

6. A process according to claim 1 wherein the back surface and mirrored surface of the belt are ground using the weight of the grinding apparatus as the sole downward pressure applied to the surface being ground.

7. A process according to claim 1 wherein the mirrored surface of the belt is ground while applying a downward pressure of up to about 25 psi to the mirrored surface.

8. A process according to claim 1 wherein the dulled surface of the belt is polished while applying a downward pressure of up to about 25 psi to the dulled surface.

9. A process according to claim 1 wherein the back surface of the belt is ground while applying a downward pressure of up to about 25 psi to the back surface.

10. A process according to claim 1 wherein the mirrored surface of the belt is ground and polished while supporting the back of the belt with a rigid member and a resilient material disposed on said member and arranged so that the resilient material is in contact with the back of the belt and said rigid member is remote from said belt and is in contact with said resilient material.

11. A process according to claim 1 wherein said back surface and said mirrored surface of the belt are ground at a rate of up to about 15 feet of belt per minute.

12. A process according to claim 1 wherein said grinding is accomplished with a grinding disc having an average diameter at least about 3 times the distance between a first distortion peak in the belt and the distortion peak next to said first distortion peak.

13. A process according to claim 1 wherein said grinding of said mirrored surface is accomplished while supporting the back surface under the area of mirrored surface being ground.

14. A refurbished steel belt prepared according to the process of claim 1.

* * * * *

UNITED STATES PATENT AND TRADEMARK OFFICE

CERTIFICATE OF CORRECTION

PATENT NO. : 4,254,589

DATED : March 10, 1981

INVENTOR(S) : Walter H. Hunt, IV; Lynn W. Craig

It is certified that error appears in the above-identified patent and that said Letters Patent are hereby corrected as shown below:

Col. 3, line 18, "about 200" should be --about 20-- .

Signed and Sealed this

*Twenty-second* Day of *December 1981*

[SEAL]

*Attest:*

GERALD J. MOSSINGHOFF

*Attesting Officer*

*Commissioner of Patents and Trademarks*